US005458063A

United States Patent [19]

Laine et al.

[11] Patent Number: 5,458,063

[45] Date of Patent: Oct. 17, 1995

[54] DEMINING DEVICE

[75] Inventors: Loïc Laine, Saint Doulchard; Philippe Arnaud, Orléans, both of France

[73] Assignee: Giat Industries, Versailles Cedex, France

[21] Appl. No.: 295,837

[22] PCT Filed: Jan. 14, 1994

[86] PCT No.: PCT/FR94/00050

§ 371 Date: Aug. 30, 1994

§ 102(e) Date: Aug. 30, 1994

[87] PCT Pub. No.: WO94/18520

PCT Pub. Date: Aug. 18, 1994

[30] Foreign Application Priority Data

Feb. 1, 1993 [FR] France ..... 93 01039

[51] Int. Cl.[6] ..... B63G 7/06; B63G 9/00

[52] U.S. Cl. ..... 102/402; 89/1.13

[58] Field of Search ..... 89/1.13; 102/427, 102/402, 403, 218, 200

[56] References Cited

U.S. PATENT DOCUMENTS

| | | | |
|---|---|---|---|
| 3,040,658 | 6/1962 | Maltby | 102/402 |
| 3,170,399 | 2/1965 | Hinman, Jr. | 102/427 |
| 3,707,913 | 1/1973 | Lee | 102/402 |
| 3,835,784 | 9/1974 | Miller et al. | 102/218 |
| 3,921,530 | 11/1975 | Burkhardt et al. | 102/219 |
| 4,012,641 | 3/1977 | Brickerd, Jr. et al. | 307/106 |
| 4,601,243 | 7/1986 | Ueda et al. | 102/200 |
| 4,615,268 | 10/1986 | Nakano et al. | 102/217 |
| 4,685,396 | 8/1987 | Birse et al. | 102/206 |
| 4,884,506 | 12/1989 | Guerreri | 102/200 |
| 4,938,136 | 7/1990 | Gould | 107/406 |
| 4,993,325 | 2/1991 | Slone, Jr. et al. | 102/402 |
| 5,027,709 | 7/1991 | Slagle | 102/427 |
| 5,323,726 | 6/1994 | Olsson | 114/221 R |
| 5,361,675 | 11/1994 | Spektor et al. | 89/1.13 |

*Primary Examiner*—Charles T. Jordan
*Assistant Examiner*—Christopher K. Montgomery
*Attorney, Agent, or Firm*—Oliff & Berridge

[57] ABSTRACT

An apparatus for activating a magnetic influenced mine from a distance includes a circuit arrangement for conserving power use and simulating the magnetic signature of a vehicle. The circuit arrangement includes a magnetic field generating coil connected to an electric feed circuit. The electric feed circuit is comprised of a voltage source, a circuit breaking element, and at least one capacitor connected to the terminals of the magnetic field generating coil. The circuit breaking element operates to alternately connect and disconnect the set of capacitors from the voltage source. By oscillating the current to the magnetic generating coil, the magnetic signature of a vehicle is simulated, and a mine is fooled into activation.

15 Claims, 4 Drawing Sheets

DEMINING DEVICE

BACKGROUND OF THE INVENTION

The present invention relates to a demining device. In partcular, the present invention provides a device designed to initiate a magnetic influenced mine from a distance.

In existing demining devices a magnetic field generating coil is attached to the front part of a demining vehicle, for example a tank, such as disclosed in German Pat. No. DE 3 444037.

The coil is linked to an electrical feed circuit which provides a current enabling a magnetic field to be generated. As a general rule, the electric feed circuit enables the current to be shaped in such a way that the magnetic field generated by the coil is similar to that of the simulated vehicle.

The shape of the current is provided by means of an electronic memory which pilots a power generator.

The major disadvantage of such a demining device is its enormous power consumption, with the existing demining devices having a continuous power consumption, of more than 2000 Watts. With such a power consumption it is not possible to use such a demining device over a long period without damaging the operational characteristics of the vehicle. An additional source of power consumption includes the requirement of the demining device to effectively operate at a great distance in the driving direction while the demining vehicle is in motion.

SUMMARY OF THE INVENTION

An object of the present invention is to propose a demining device which consumes less power than existing devices.

The invention also enables a magnetic field to be supplied near to a field generated by a real vehicle. It is therefore no longer necessary to rely on an electronic memory to pilot a demining vehicle.

The invention proposes a simpler, more compatible and less expensive demining device than known devices, wherein such a simplification has not led to a deterioration in its demining performances.

The present invention provides these and other features in a demining device, designed to initiate a magnetic influenced mine from a distance comprising a magnetic field generating coil and its electric feed circuit, the feed circuit comprising a capacitance mounted in parallel on the coil terminals and circuit breaker enabling this capacitance to be connected to and disconnected from a voltage source.

In one preferred embodiment, the circuit breaker periodically activates a sequence comprising a connection followed by a disconnection.

According to one particular embodiment of the invention, the circuit breaker comprises a transistor wherein the Drain is connected to the capacitance and the Source is connected to the voltage source, the transistor Gate receiving the pulses supplied by a electrical control circuit.

According to one variant, the capacitance is constituted by two electrochemical capacitances connected in series to one another by means of one of their electrodes of the same sign, each capacitance being shortcircuited by a diode enabling a current to pass in the opposite direction to that of the capacitance in question.

According to a second embodiment of the invention, the voltage source comprises a capacitor and the circuit breaker is comprised of a commutator which connects the capacitor to the power supply when the capacitance has been disconnected.

BRIEF DESCRIPTION OF THE DRAWINGS

The invention will be better understood after reading the description which will follow of the particular embodiments of the invention, a description which refers to the accompanying figures in which.

DETAILED DESCRIPTION OF PREFERRED EMBODIMENTS

Figure 1:
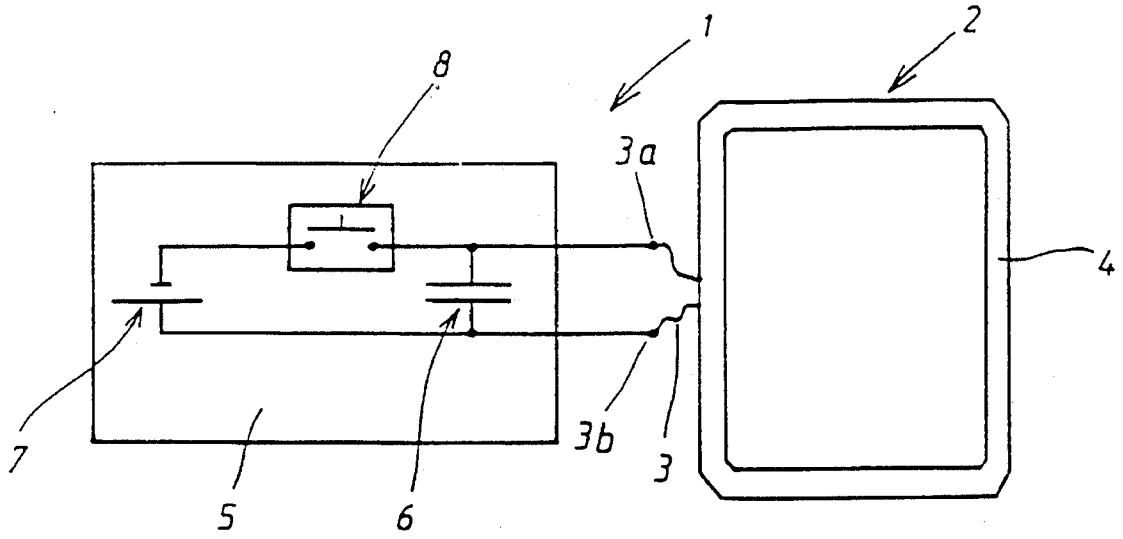
FIG. 1 represents a skeleton diagram of a demining device according to the invention.

As shown in FIG. 1, a demining device 1 according to the invention comprises a coil 2 constituted in a known way by a wire 3 wound around a support plate 4.

The support plate is designed to be made integral with the front part of a vehicle (not represented). It is made integral, for example, by means of straps (not represented).

The ends **3*a* and 3*b* of the coil wire constitute the terminals of the coil 2**.

A feed circuit 5 of this coil comprises a capacitor 6, which is mounted in parallel on the terminals **3*a* and 3*b* of the coil. The capacitor 6 is connected to a voltage source 7 by means of a circuit breaker 8**.

The circuit breaking means enable the voltage source 7 and the electrical circuit constituted of the capacitor 6 and the coil 2 to be connected and disconnected at will.

A particular embodiment of these means will be described below.

The functioning of this device will now be described with reference to FIG. 2 which represents the current I flowing through the coil 2 according to the time t.

First, the circuit breaking means 8 are activated in order to connect the voltage source 7 to the capacitor 6. The latter charges up and the current flowing through the coil 2 increases until it reaches a maximum value Imax after a lapse of time t1.

Whereafter the circuit breaking means 8 are activated in such a way as to disconnect the voltage source from the capacitance.

The circuit comprising the capacitor 6 and the coil 2 thereafter becomes an oscillating circuit, the current flowing through the coil being sinusoidal at damped amplitude.

The shape of the current obtained enables a magnetic field of an analogous shape to be generated in the coil which is close to that of the magnetic signature of a real vehicle.

After a time lapse t2, the capacitor may be connected once again to the voltage source 7 for a further lapse of time t1, and the circuit opened again.

Figure 2:
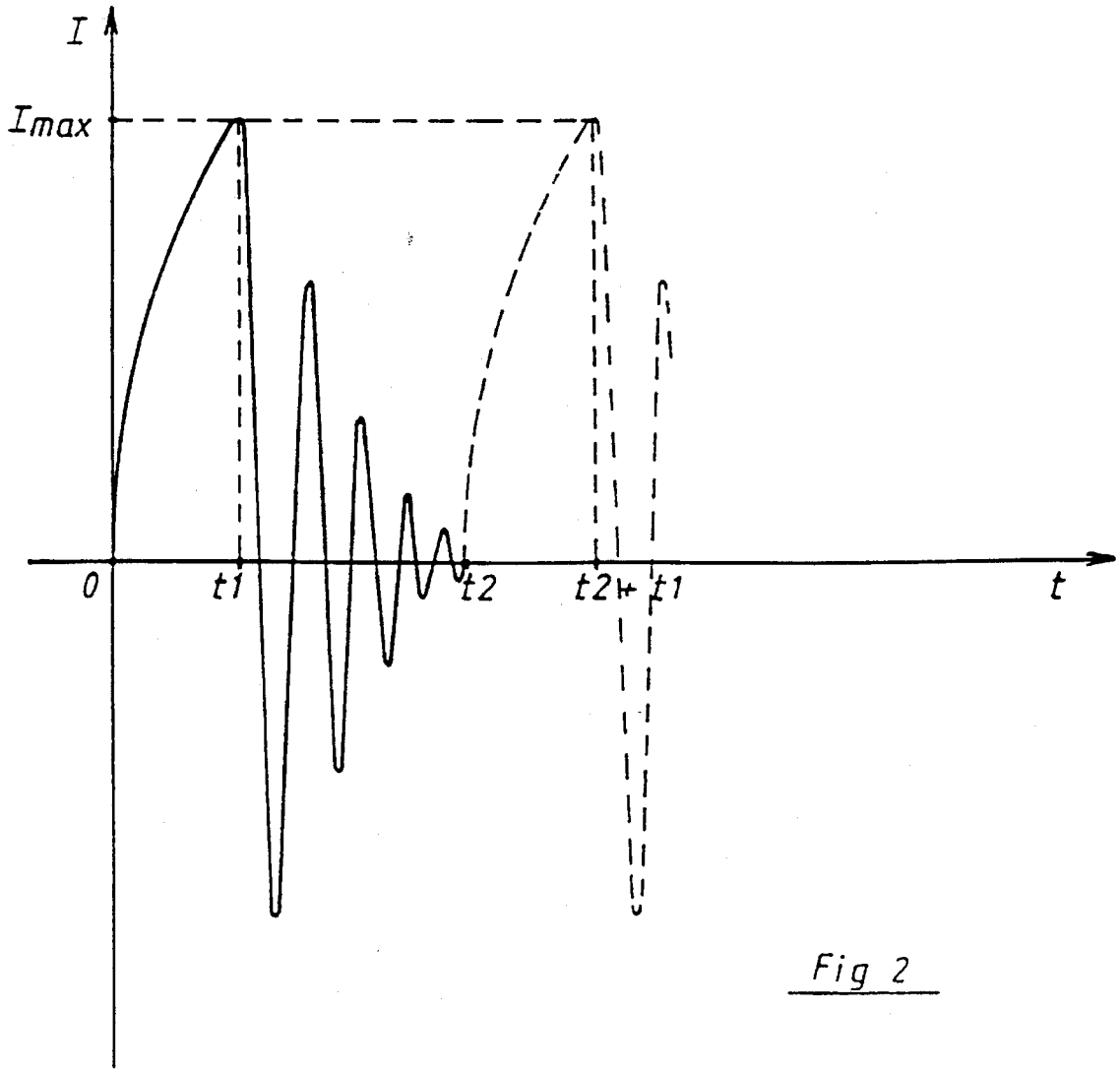
FIG. 2 is a curve illustrating the shape of the current flowing through the coil in the device according to the invention.

The curve of the current obtained during this second cycle is represented on FIG. 2 by the dotted line.

The values of the capacitance 6, the inductance and resistance of the coil 2 as well as the lapses of time t1 and t2 may be altered in order to modify the shape of the magnetic field generated by the device.

For example, it is preferable to choose a coil such that its R/2L ratio (where R represents the resistance of the coil and L its inductance) falls between 8 and 12. Such values enable coils to be obtained, wherein the damping time constant falls between 80 and 120 milliseconds.

A capacitance C will therefore be chosen wherein the free oscillation rate of the capacitance-coil circuit falls between 10 and 20 Hz. A capacitance of approximately 0.01 Farad gives a satisfactory performance for a coil wherein the inductance is around 50 milli henry.

With such values, the duration t1 will be in the region of 200 milliseconds, in other words, two damping time constants of the coil. The circuit will then be allowed to oscillate for 5 to 10 periods of the capacitance-coil oscillating circuit (i.e. between 0.5 and 1 second for a rate of 10 Hz).

The device thus described has a lower power consumption than known devices.

In fact, it draws from the voltage source 7 the necessary power to establish the current in the coil for t1. Thereafter, up to t2, it draws no power from the voltage source.

On the contrary, the systems according to prior art draw power from the voltage source continuously.

With equal power loss in the choke, the power saving obtained by using the device according to the invention may be above or equal to 50%. It generally depends on the properties of the coil. Using the values given previously as an example, the power saving is somewhere in the region of 70%.

Figure 3:
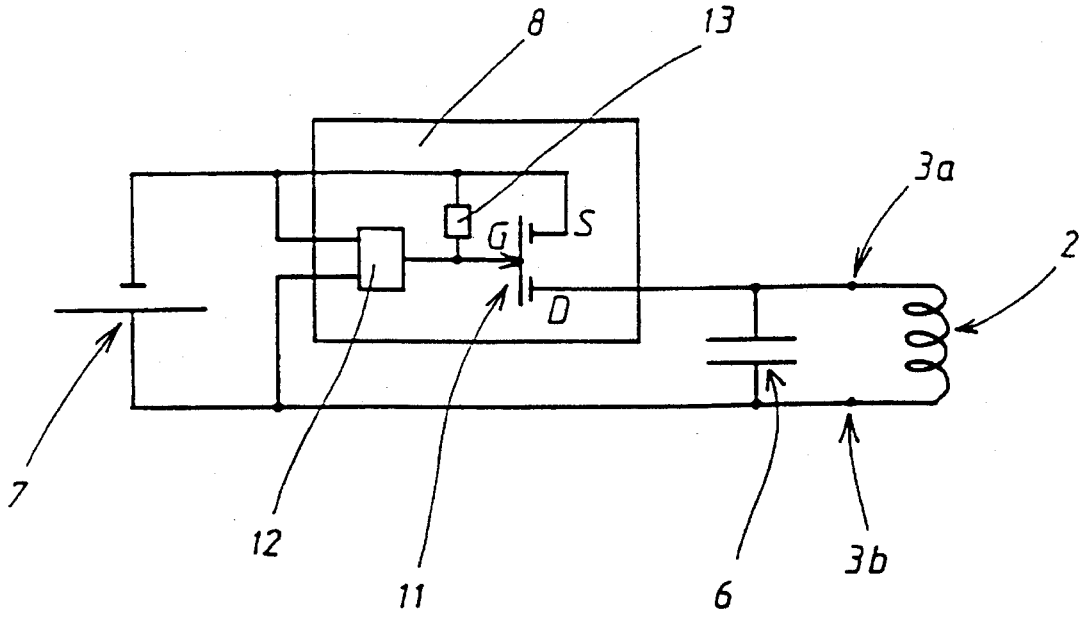
FIG. 3 represents a diagram of circuit breaking means used in the device according to the invention.

FIG. 3 represents a diagram of the circuit breaking means 8 which may be used in the device according to the invention. The coil 2 is represented as a skeleton diagram in this figure.

The circuit breaking means 8 comprise a MOS-type (Metal Oxide Semiconductor) transistor 11 wherein the Drain (D) is connected to the capacitance 6 and the Source (S) is connected to the voltage source 7.

The gate (G) of the transistor 11 receives the signals emitted by an electronic control circuit 12.

The latter is fed by the voltage source 7 and it emits a signal comprised of power pulses of an equal length to t1 and an equal period to t2.

The control circuit 12 also comprises a circuit breaker (not represented here) which enables the device to be switched on and off.

Such a pulse-generating control circuit is well known to those of ordinary skill and will not be described herein in further detail.

The voltage pulse amplitude will be adapted to suit the properties of the MOS transistor 11, usually in the region of 5 volts.

A resistor 13 connects the gate G to the voltage source 7, its object is to adapt the impedance of the control circuit 12 with the MOS gate.

These circuit breaking means function as follows: when the control circuit 12 is started up, it emits a signal comprising pulses of a duration of t1 which are followed by a period of t2.

The leading edge of the first pulse, applied to the gate G of the transistor 11, enables the current to flow from the Source S towards the Drain D. The circuit breaking means 8 thereafter activate the connection of the capacitor 6 to the voltage source 7. The capacitor thereafter being charged by the voltage source 7 as previously described.

After the time t1 has elapsed, the gate G of the transistor 11 receives the back edge of the first pulse provided by the control circuit 12.

This back edge insulates the transistor 11, the circuit breaking means thereby activate the disconnection of the capacitor 6 and the voltage source 7. The capacitor 6 discharges into the coil 2 and together these two elements form an oscillating circuit as previously described.

After the time t2 has elapsed, the control means apply a second pulse to the transistor 11 of a duration equal to t2. This in turn causes a new connection followed by a disconnection.

Other circuit breaking means 8 could be envisaged, for example a static relay or electro-mechanical relay.

Figure 4:
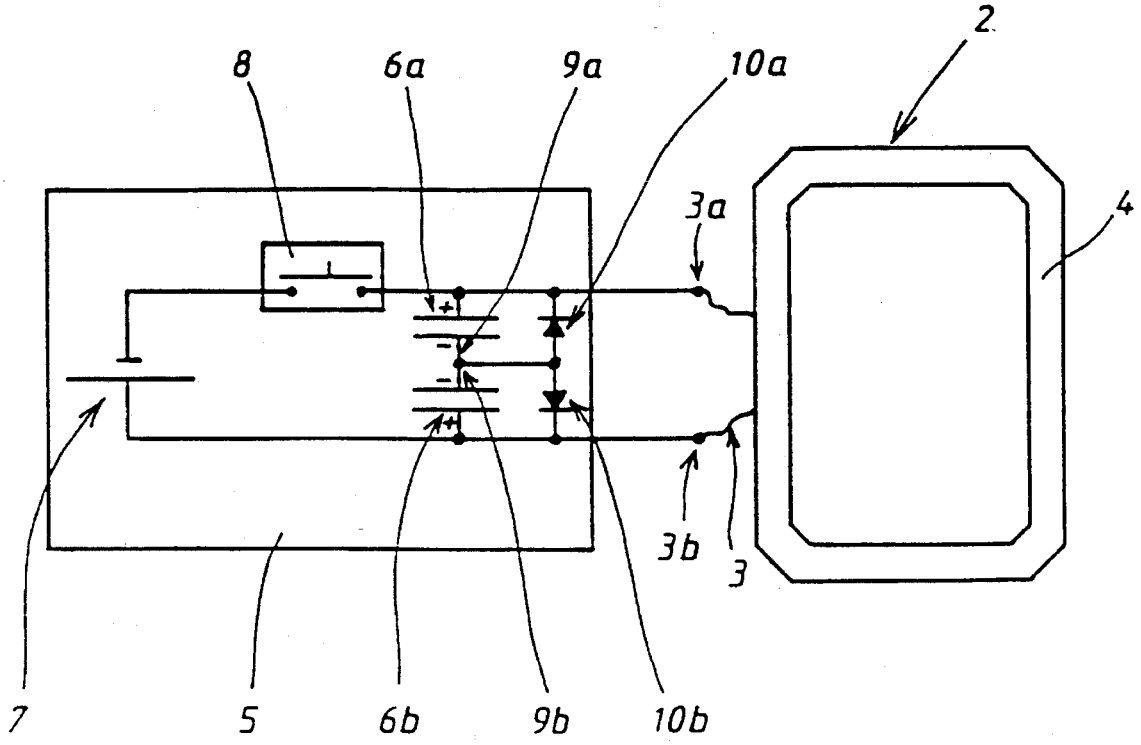
FIG. 4 represents a skeleton diagram of a variant of the demining device according to the invention.

FIG. 4 represents a variant of the device according to the invention.

The use of electro-chemical capacitors will be advantageous for relatively strong capacitance values. Electro-chemical capacitors are polarized and can not therefore work for both positive and negative alternation of the current flowing in the coil.

In a proposed variation the capacitor 6 is replaced by two electro-chemical capacitors **6*a* and 6*b* which are mounted in series and connected to one another by one of their electrodes of the same sign, in this case the negative electrodes 9*a* and 9*b***.

Each capacitor is short-circuited by a diode **10*a* and 10*b*** which enable a current to pass in the opposite direction to that of the capacitance in question.

The curve of the current flowing in the coil 2 obtained by this variant is of the same type as that previously described with reference to FIG. 2.

We must observe, however, that when the capacitors **6*a* and 6*b*** are discharged, the negative parts of the damped oscillations are supplied by the discharge of one capacitor whereas the positive parts are supplied by the discharge of the other capacitor.

When the capacitance is connected to the voltage source 7, the latter charges the capacitor **6*b*. The capacitor 6*a*** charges up during the first oscillation of the oscillating circuit constituted by the capacitors and the coil.

Figure 5:
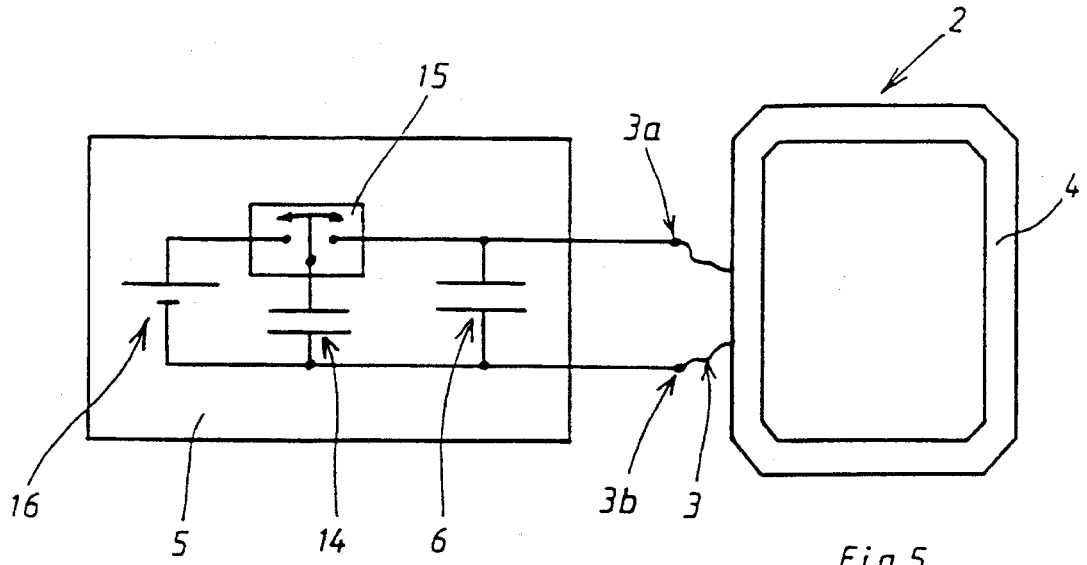
FIG. 5 represents a skeleton diagram of a second embodiment of the demining device according to the invention.

FIG. 5 represents a second embodiment of the device according to the invention.

In this embodiment, the voltage source is provided by a capacitor 14. The circuit breaking means are comprised of commutator means 15, in other words of means which, on the one hand, activate the connection and disconnection of the capacitance 6 to the voltage source provided by the capacitor 14, and which, on the other hand, connect the capacitor 14 to a power supply 16, when the capacitor 6 is disconnected.

A particular embodiment of the commutator means 15 will be described hereafter.

Figure 6:
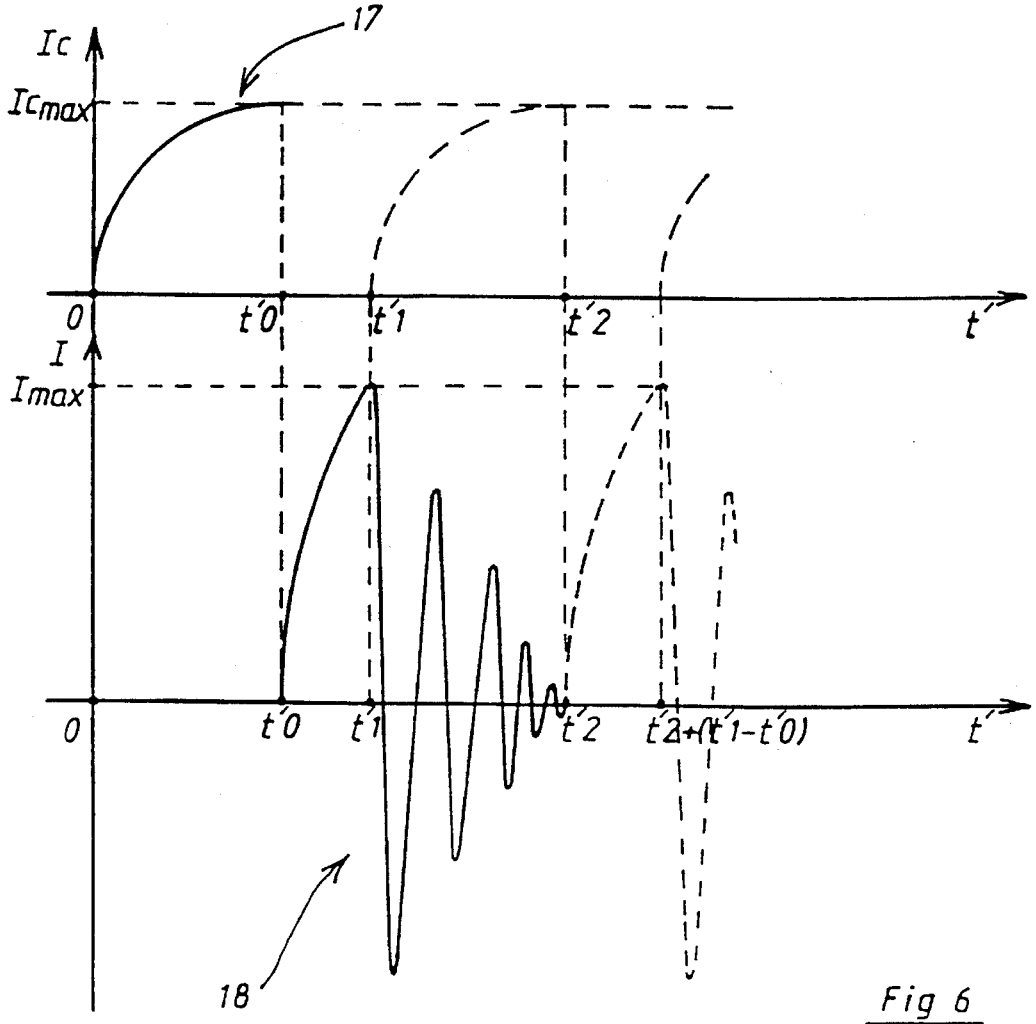
FIG. 6 represents two curves which illustrate, for a device according to the second embodiment of the invention, on the one hand, the charge rate of the feed capacitor and on the other, the shape of the current flowing through the coil, FIG. **7*a* represents a diagram of a commutator used in the device according to the second embodiment of the invention.

This second embodiment according to the invention will be described in operation with reference to FIG. 6.

The commutator means 15 initially connect the capacitor 14 to the power source 16 (which for example may comprise a battery). The upper curve 17 represents the fluctuations in the capacitor 14 current 1*c* over a period of time. This current reaches its maximum 1cmax after time t'0.

Thereafter the commutator means 15 connect the capacitor 14 to the capacitor 6, disconnecting the capacitor 14 from the power source 16 at the same time.

The capacitor 14 charges the capacitor 6 for the duration of L'1-t'0. The current flowing through the coil 2 increases until it reaches its maximum value 1max after a period of time equal to t'1-t'0 (see lower curve 18). The capacitor 14 totally discharges into the capacitor 6 and the coil 2.

As soon as t'1 is reached the commutator means 15 are activated so as to disconnect the capacitor 14 from the capacitor 6.

The circuit constituted by the capacitor 6 and the coil 2 thereafter becomes an oscillating circuit, the current flowing through the coil being sinusoidal at damped amplitude.

The shape of the current thereby obtained enables a magnetic field of analogous shape to be generated in the coil which is close to the magnetic signature of a real vehicle.

During this time the capacitor 14 is once again connected to the power source 16 and is recharged (see curve 17).

The charge time will be selected such that it is possible to reconnect the capacitor 14 to the coil 2 after the period of time t'2-t'1. This connection will be maintained for a further period equal to t'1-t'0 in order to re-establish the current in the coil, after which time the capacitor 14 will be disconnected once again from the capacitor 6.

The current curves obtained during this second cycle are represented as a guide by the dotted lines on FIG. 7. As for the first embodiment of the invention previously described, it is possible to alter the values of the capacitor 6, the inductance and resistance of the coil 2 and the times t'1 and t'2 in order to modify the shape of the magnetic field generated by the device.

The capacitor 14 will have, in any event, a capacity C1 greater than that of the capacitor 6.

The value of C1 will be fixed according to the inductance L and the resistance R of the coil in such a way that the circuit constituted by the capacitor 14 and the coil 2 is aperiodic critical which means that C1 will be such that LC1 equals $(2L/R)^2$.

As a guide, with previously defined values, in other words a coil 2 with inductance L in the region of 0.01 Farad, a capacitor 14 could be selected wherein the capacity C1 is in the region of 0.1 Farad.

With such values the charge time t'1-t'0 is always in the region of 200 milliseconds, or approximately two damping time constants of the coil. The circuit oscillates for 5 to 10 periods of the capacitance-coil oscillating circuit (in other words between 0.5 and 1 second for a frequency of 10 Hz).

The oscillation time is enough to enable the capacitor 14 to be recharged by the power source 16.

The device according to this second embodiment of the invention has a lower power consumption than known devices.

Nevertheless its power consumption is greater than that of the device according to the first embodiment of the invention, and that mainly because of the losses which occur during the discharge of the capacitor 14 in the capacitor 6.

With equal power loss in the choke, the power saving obtained by using this embodiment of the invention is estimated at 50% of that of a device according to prior art.

The main advantage of this embodiment over the preceding one is that it enables the value of the maximum discharge current of the vehicle's battery to be limited.

In fact, in the first embodiment of the invention, the battery constituted the voltage source 7 connected to the capacitor 6, it produced a current in the region of 20 Amps.

In the second embodiment of the invention, the battery constitutes the power supply 16. It is therefore connected to a capacitor 14 for a longer period (in the region of 100%) which enables the power output to be limited to 10 Amps.

The battery discharge current being limited increases the service life of the latter and the reliability of the device.

Figure 7A:
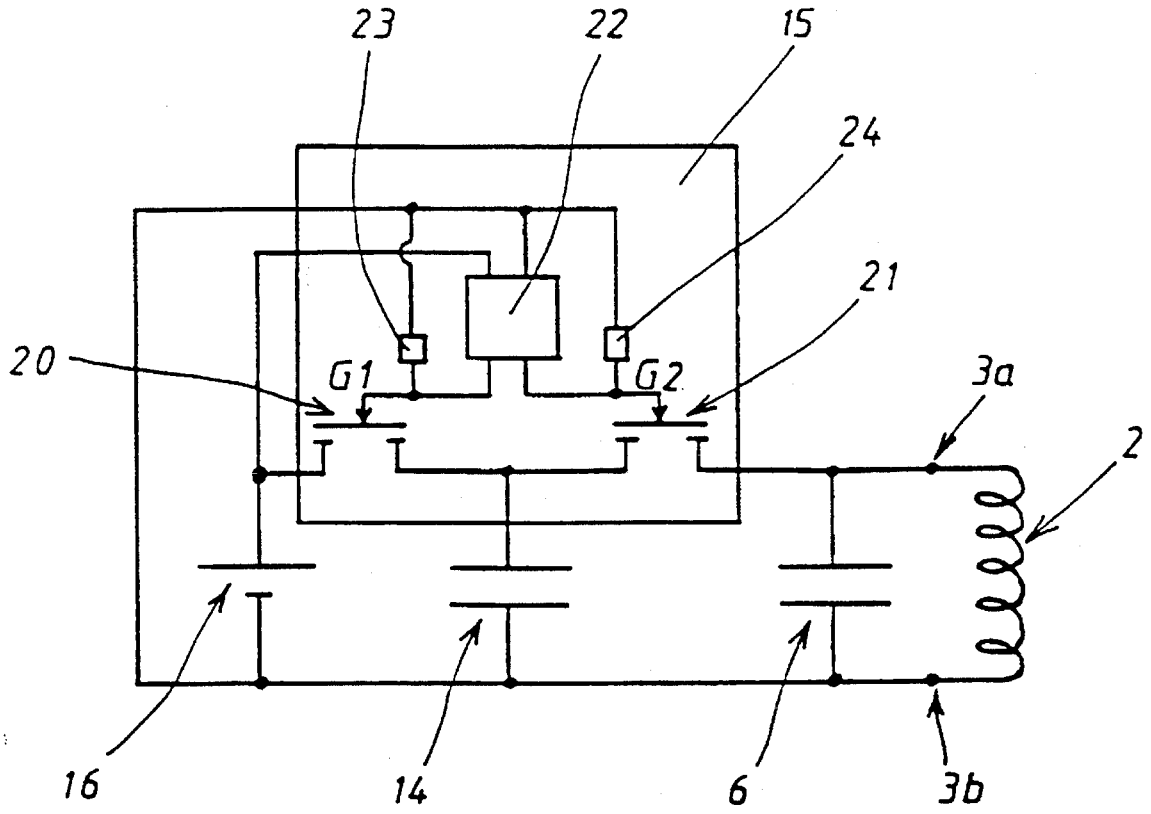
FIG. 7*b*** illustrates the shape of the pulses produced by the control generator.

FIG. 7*a* represents an example of commutator means 15 which may be used in this second embodiment.

These commutator means comprise two MOS-type transistors 20 and 21 of which the respective gates G1 and G2 each receive a different control signal from a control generator 22.

The control generator 22 also comprises a switch (not represented) designed to turn the device on and off.

Transistor 20 receives signal S1 and transistor 21 receives signal S2.

These signals are constituted of a succession of specific pulses as will be described herebelow.

The control generator 22 is supplied with power by means of power source 16 (constituted, for example, by the battery of the vehicle). The resistors 23 and 24 are placed between the gates G1 and G2 of transistors 20 and 21 of the power source 16. Their purpose is to adapt the impedance of the control generator 22 with the transistor gates.

Transistor 20 is designed to connect the capacitor 14 to the power source, transistor 21 enables the capacitor 14 to be connected to the coil 2 (represented as a skeleton diagram).

Figure 7B:
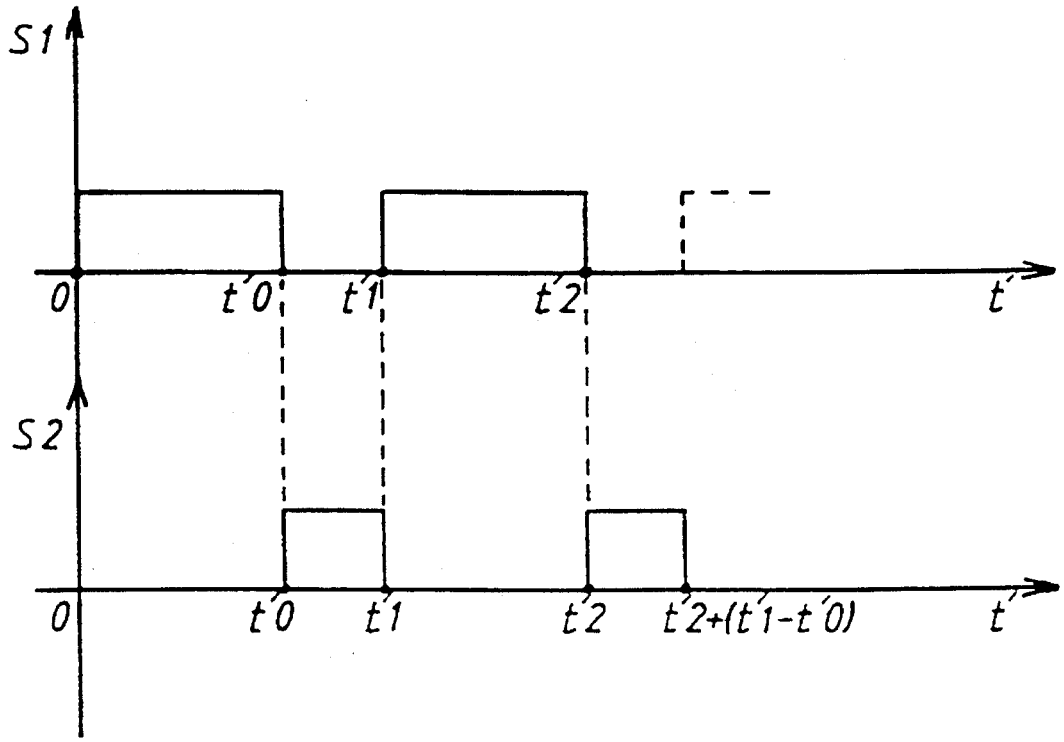

FIG. 7*b* shows signals S1 and S2 which are applied by the control generator 22 to the transistors 20 and 21.

Signal S1 (upper curve) is constituted by a series of pulses of a width of t'1, signal S2 (lower curve) is constituted by a series of pulses of a width of t'1-t'0. The two signals have a same period equal to t'1.

The amplitude of the power pulses is adapted to the properties of the MOS transistors, it is usually in the region of 5 volts.

Therefore, when the gate G1 receives the leading edge of the first pulse of signal S1, the transistor 20 connects the capacitor 14 to the power source 16. This connection is maintained for a length of time t'0 in which time the capacitor 14 is charged (see FIG. 6).

During the same period of time, the transistor 21 receives no signals at its gate G2 and thereby insulates the capacitor 14 from the coil 2.

At the end of the period of time t'0, the transistor 20 becomes non-conducting whereas transistor 21 receives the leading edge of the first pulse of signal S2. The transistor 21 thereafter connects the capacitor 14 to the coil 2 for a period of time t'1-t'0, such time as is needed to establish a current in the coil 2.

After t'1, transistor 21 becomes non-conducting once again enabling the damped sinusoidal rate to become established in the circuit constituted by the capacitance 6 and the coil 2.

At the same time, the signal S1 has ordered the reconnection of the capacitor 14 to the power source 16, thus enabling it to be recharged.

Such a commutation cycle may be repeated indefinitely.

Other commutator means 15 could be envisaged, for example using static relays or electromagnetic relays.

I claim:

1. A method for activating a magnetic influenced mine from a distance, comprising the steps of:

connecting at least one capacitor with a power source for time t1:

discharging the capacitor through a magnetic field generator coil for time t2;

re-connecting the power source for time t1 to the capacitor after time t2; and controlling the connection between the capacitor and power source with an electronic control connected in series to a transistor, the capacitor and the power source.

2. A method for activating a magnetic influenced mine from a distance, comprising the steps of:

charging a first at least one capacitor with a power source for time t0-t'0:

discharging the first at least one capacitor into a second at least one capacitor and a magnetic field generating coil for time t'0-t'1;

discharging the second at least one capacitor into a magnetic field generating coil for time t'1-t'2 while recharging the first at least one capacitor with the power source; and recharging the second at least one capacitor with the first at least one capacitor for time t'2-t'2 +(t'1-t'0).

3. A method for activating a magnetic influenced mine from a distance, comprising the steps of:

generating a timed signal S1 within a control generator;

directing S1 to a first transistor for electrically connecting a power source to a first at least one capacitor for the duration for S1, where the power source charges the first at least one capacitor;

generating a timed signal S2 within the control generator when the timed signal S1 has ended;

directing S2 to a second transistor for electrically connecting the first at least one capacitor to a second at least one capacitor and a magnetic field generating coil for the duration of S2, wherein the first at least one capacitor discharges into the second at least one capacitor and the magnetic field generating coil; and re-generating the timed signal S1, within the control generator, when the timed signal S2 has ended.

4. A demining device for activating a magnetic influenced mine from a distance, comprising:

a magnetic field generating coil for generating a magnetic signature; and an electric feed circuit connected to the magnetic field generating coil, the electric feed circuit having at least one capacitor and a circuit breaker, said at least one capacitor being mounted to terminals of the magnetic field generating coil and inducing a current within the magnetic field generating coil, and said circuit breaker controlling the flow of current from a power source to the at least one capacitor, wherein the circuit breaker comprises a transistor having a drain, a source, and a gate, wherein the drain is connected to the at least one capacitor, the source is connected to the power source, and the gate receives pulses supplied by an electronic control circuit, and wherein the circuit breaker periodically activates a sequence comprising a connection followed by a disconnection.

5. The demining device according to claim 4, wherein the circuit breaker further comprises a MOS-type transistor.

6. A demining device for activating a magnetic influenced mine from a distance, comprising:

a magnetic field generating coil for generating a magnetic signature; and an electric feed circuit connected to the magnetic field generating coil, the electric feed circuit having at least one capacitor and a circuit breaker, said at least one capacitor being mounted to terminals of the magnetic field generating coil and inducing a current within the magnetic field generating coil, and said circuit breaker controlling the flow of current from a power source to the at least one capacitor, wherein the at least one capacitor comprises two electro-chemical capacitors connected in series, and wherein the two electro-chemical capacitors are short circuited by diodes enabling current to flow in an opposite direction to that of the two capacitors.

7. The demining device according to claim 6, wherein the inductance resistance ratio is represented by the following equation:

$$8 \leqq R/2L \leqq 12$$

where R is the resistance and L is the inductance of the magnetic field generating coil.

8. The demining device according to claim 7, wherein the at least one capacitor has a capacitance of about 0.01 Farad.

9. The demining device according to claim 7, wherein the inductance of the coil is about 50 milli-henries.

10. The demining device according to claim 7, wherein the power source is a voltage source generating about 5 volts.

11. The demining device according to claim 7, wherein the circuit breaker comprises a static relay.

12. The demining device according to claim 7, wherein the circuit breaker comprises an electro-mechanical relay.

13. A demining device for activating a magnetic influenced mine from a distance, comprising:

a magnetic field generating coil for generating a magnetic signature; and an electric feed circuit connected to the magnetic field generating coil, the electric feed circuit having at least one capacitor and a circuit breaker, said at least one capacitor being mounted to terminals of the magnetic field generating coil and inducing a current within the magnetic field generating coil, and said circuit breaker controlling the flow of current from a power source to the at least one capacitor, wherein the power source comprises a secondary capacitor and the circuit breaker comprises commutator means for connecting the secondary capacitor to the power source when the at least one capacitor is disconnected.

14. A demining device for activating a magnetic influenced mine from a distance, comprising:

a magnetic field generating coil for generating a magnetic signature; and an electric feed circuit connected to the magnetic field generating coil, the electric feed circuit having at least one capacitor and a circuit breaker, said at least one capacitor being mounted to terminals of the magnetic field generating coil and inducing a current within the magnetic field generating coil, and said circuit breaker controlling the flow of current from a power source to the at least one capacitor, wherein the circuit breaker comprises a circuit composed of an on/off switch and commutator means for controlling the flow of power to the at least one capacitor; said at least one capacitor comprises a first and a second set of capacitors; and the commutator means alternately electrically connects (a) the power source to the first set of capacitors and (b) the first set of capacitors to both the second set of capacitors and the magnetic field generating coil.

15. A demining device for activating a magnetic influenced mine from a distance, comprising:

a magnetic field generating coil for generating a magnetic signature; and an electric feed circuit connected to the magnetic field generating coil, the electric feed circuit having at least one capacitor and a circuit breaker, said at least one capacitor being mounted to terminals of the magnetic field generating coil and inducing a current within the magnetic field generating coil, and said circuit breaker controlling the flow of current from a power source to the at least one capacitor, wherein the circuit breaker comprises a circuit composed of an on/off switch, a control generator, and at least two transistors, said electric feed circuit comprising a first and second set of at least one capacitor; said control generator alternately electrically connects (a) the power source to the first set of capacitors and (b) the first set to the second set of capacitors.

* * * * *